United States Patent [19]

Albinson

[11] 3,966,252

[45] June 29, 1976

[54] CHAIR STRUCTURE AND TILT MECHANISM THEREFOR

[75] Inventor: Don C. Albinson, Coopersburg, Pa.

[73] Assignee: Westinghouse Electric Corporation, Pittsburgh, Pa.

[22] Filed: May 28, 1974.

[21] Appl. No.: 473,965

[52] U.S. Cl. ..... 297/306; 297/411; 297/361

[51] Int. Cl.[2] ..... A47C 7/44

[58] Field of Search ..... 297/292, 300, 301, 304, 297/306, 285, 286, 289, 323, 411, 418, 412

[56] References Cited

UNITED STATES PATENTS

| | | | |
|---|---|---|---|
| 2,321,385 | 6/1943 | Herold | 297/301 |
| 2,341,124 | 2/1944 | Sheldrick | 297/301 |
| 2,374,350 | 4/1945 | Herold | 297/301 |
| 2,447,601 | 8/1948 | Sengpiel | 297/301 |
| 2,471,024 | 5/1949 | Cramer | 297/301 |
| 2,650,646 | 9/1953 | Herold | 297/301 |
| 2,859,801 | 11/1958 | Moore | 297/323 X |
| 2,970,639 | 2/1961 | Good | 297/411 |
| 3,072,436 | 1/1963 | Moore | 297/304 |
| 3,603,640 | 9/1971 | Doerner | 297/292 |

*Primary Examiner*—Francis K. Zugel
*Attorney, Agent, or Firm*—B. R. Studebaker

[57] ABSTRACT

An improved chair structure and tilt mechanism for office chairs and the like wherein the chair back is mounted to the tilt mechanism through the chair arms causing the chair arms to thus move forward and backward in conjunction with like movement of the chair back independently of any movement or tilt of the chair seat.

4 Claims, 18 Drawing Figures

CHAIR STRUCTURE AND TILT MECHANISM THEREFOR

BACKGROUND OF THE INVENTION

The use of the so-called "posture" chair in business offices is commonplace. There are several types of the so-called "posture" chairs which are utilized for the comfort and convenience of office workers. These chairs vary from the simple secretarial chair where only the back tilts slightly, to the executive posture chair wherein the back tilts to a greater degree than the seat which also may or may not tilt. The shell type chair which is in common usage today provides a completely molded unitary seat, back and arms which tilt as a unit with respect to a pedestal base. This chair, although visually pleasing, because of its unitary construction when tilted lifts the front edge of the seat the same distance away from the floor as the top edge of the back moves toward the floor thus raising the occupant's feet, in many instances, off of the floor and is not completely satisfactory in terms of comfort. Another common chair construction is one in which the seat remains stationary with respect to the pedestal base and the arms remain stationary because of direct connection to the seat, while the back is permitted to tilt at angles of varying degrees generally controlled by a control mechanism. In this type chair, the back moves relative to the arms and if significant overlap is not provided the user can be caught between the back of the chair and the ends of the arms as the back proceeds past the rearward end of the chair arms. This condition is also quite uncomfortable because as the body moves back in relationship to the stationary arms, the user's arms must slide along the upper surface of the chair arms or change their position at the shoulder with respect to the user's body. The most comfortable office type chair in present usage is one in which a sophisticated tilt mechanism of the type disclosed in U.S. Pat. No. 3,603,640 to J. T. Doerner is employed. This type tilt mechanism allows the seat of the chair to tilt at a lesser angle than the chair back tilts through simultaneous movement of both the chair back and the seat at different rates of movement. Although this configuration permits the user's body to remain in more of an L-shaped configuration rather than flattening it out as the stationary seat requires, it also has the deficiency of being used almost solely with chairs whose arms are fixed with respect to the seat and therefore when the back of the chair tilts to a greater degree than the seat, there is still relative movement between the chair back and the chair arms leading to the same kinds of discomfort and possible hazard described with respect to the fixed seat reclining back chair.

In addition to the discomfort factors indicated above with respect to the conventionally employed office seating, mechanical deficiencies are also apparent. In almost every instance, the chair tilt mechanism is located centrally beneath the seat and the back is generally supported from the rearward end of the tilt mechanism centrally of the chair seat through a single central support. This single central support must be of extremely heavy gauge steel in order to support the upper body of heavier chair users. In every instance where the chair arms are connected to the seat whether the seat tilts or not, where there is either a differed degree of movement between the chair back and the chair seat or movement of the chair back only, the arms can only be supported at their lower most ends and when subject to high loads at the upper arm rest portion can fail through the cantilevered action of the loading when lateral force is applied.

An additional problem with much of the office seating available today is that many of the control mechanisms or the central support for the chair back, which may also include externally located height adjustment mechanisms, extend beyond the chair silhouette and because of their heavy metallic construction can cause damage to adjacent office furniture when the chair is easily moved on its casters through direct contact of these parts with such adjacent furniture.

SUMMARY OF THE INVENTION

This invention relates to office seating and more particularly to an improved combination chair structure and tilt mechanism for a wide range of office chairs. The above described deficiencies of the prior art chair structures are obviated by providing an office chair in which the back of the chair is completely supported by the chair arms which in turn are directly connected for support to the chair tilt mechanism thus providing a structure in which any tilting of the chair back is accompanied by simultaneous and equivalent tilting of the arms with the back, there being no tie-in between the seat structure and the arms. Because of the bridge provided by the chair back between the upper end of the arms, the mounting becomes as sturdy as that of a non-tilting chair and when the chair user tilts backward in his chair, his body and arms move together thus eliminating the uncomfortable feeling of the arms remaining stationary while the user's body moves rearwardly. Additionally, with the arms moving in unison with the back of the chair there is no gapping between the arms and the back to provide a hazardous situation.

The foregoing is accomplished in accordance with the present invention by providing in an office chair having a seat structure, a back structure, a base for supporting the chair on the floor and a tilt mechanism mounted at the top of the base for independently supporting the seat and the back, the improved construction which provides for one portion of the tilt mechanism to be directly connected to the seat while a pair of laterally disposed chair arms are mounted on means which interconnect the laterally disposed chair arms to another portion of the tilt mechanism with the chair arms also being directly connected to the back structure whereby the chair arms and the back structure tilt as a unit independently of the seat. The means interconnecting the laterally disposed chair arms is generally in the form of an elongated bar connected approximate its midpoint to the tilt mechanism and at its laterally extending extremities to the chair arms.

BRIEF DESCRIPTION OF THE DRAWINGS

Many of the attendant advantages of this invention will become more readily apparent and better understood as the following detailed description is considered in connection with the accompanying drawings in which.

DESCRIPTION OF THE PREFERRED EMBODIMENTS

Figure 1:
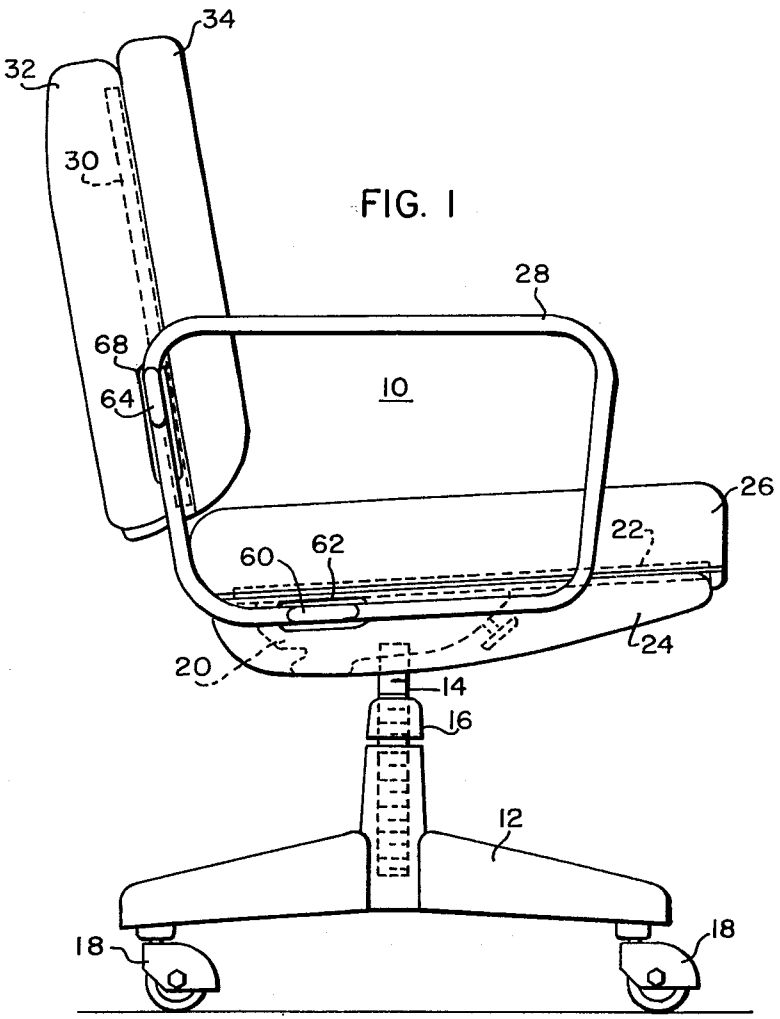
FIG. 1 is a side elevational view of an executive type posture chair constructed in accordance with this invention.

Referring now in detail to the drawings wherein like reference characters represent like parts throughout the several views, there is illustrated in FIG. 1 an executive "posture" chair generally designated 10 constructed in accordance with this invention. The "posture" chair 10 includes in conventional combination a pedestal base 12 including a chair post or spindle 14 and a seat height adjustment collar 16. The pedestal base may be mounted on conventional casters 18. The chair post or spindle 14 is directly connected to the tilt mechanism 20 which will be later described in detail. The tilt mechanism 20 is connected directly to the structural seat support 22 which in turn also carries the molded seat shell 24 and the fabric covered seat cushion 26. Also included in the chair combination are a pair of laterally disposed chair arms 28 and a chair back which include a structural chair back member 30 (FIG. 4) which is surrounded by the molded chair back shell 32 and a fabric covered chair back cushion 34.

Figure 6:
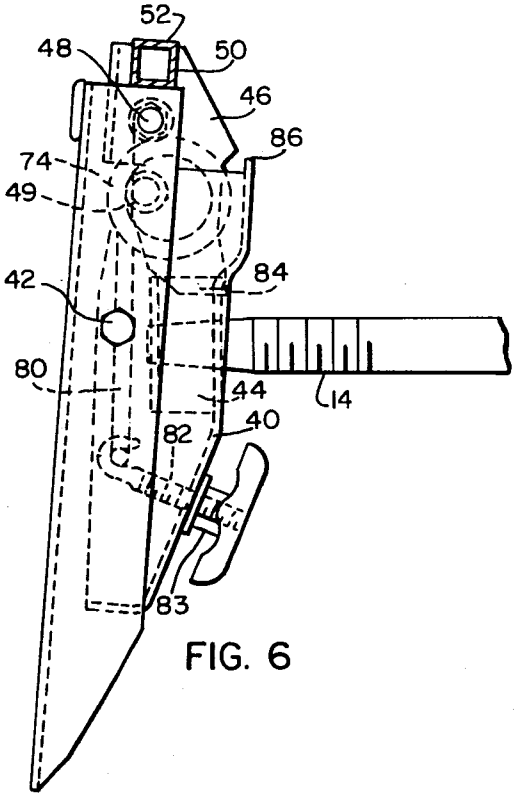
FIG. 6 is a side elevational view thereof.
Figure 5:
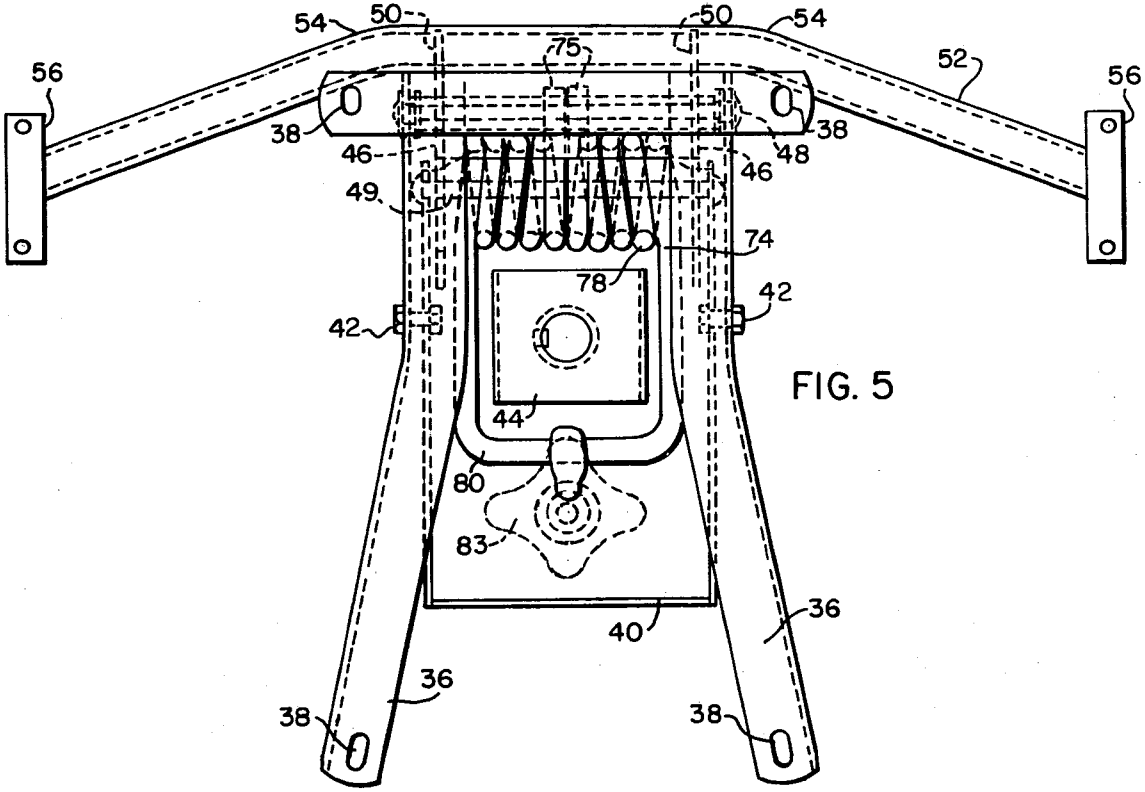
FIG. 5 is a top plan view of a tilt mechanism modified in accordance with this invention.
Figure 7:
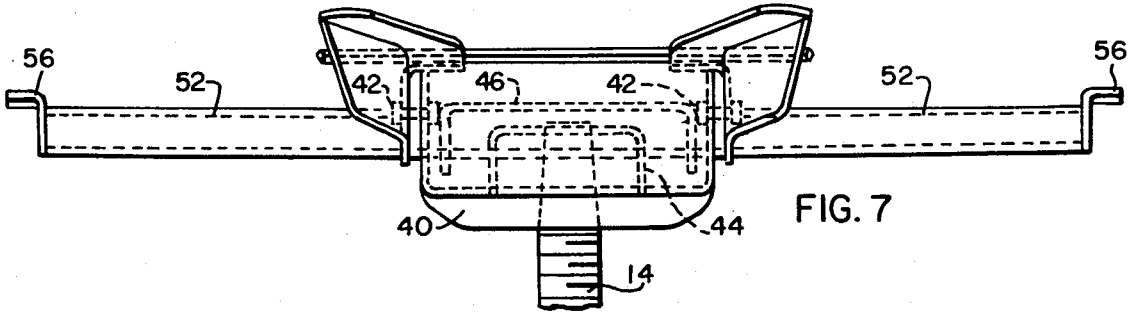
FIG. 7 is a front elevational view thereof.

The modified tilt mechanism disclosed in FIGS. 5 through 7 is generally constructed in accordance with the tilt mechanism disclosed in U.S. Pat. No. 3,603,640 issued Sept. 7, 1971 to Joseph T. Doerner and includes a pair of spaced apart independent support members 36 which are secured to the seat structural member 22 at 38. The spaced apart independent support members 36 form a first frame member which is pivotally connected to a second frame member 40 for pivotal movement therebetween by means of pins 42 which are entered through the respective sides of the first frame members 36 and the second frame member 40. The pan shaped frame member 40 provides a space for containing and concealing the control mechanism and the means for mounting the second frame member 40 on the conventional chair post or spindle 14 comprises an inverted U-shaped plate 44 which is mounted on the bottom of member 40 on the inside thereof and secured in place by staking.

The plate 44 is provided with an aperture to register with a corresponding aperture to the bottom of the member 40. These apertures provide the conventional means for mounting the control on the top end of the chair base spindle 14.

Figure 3:
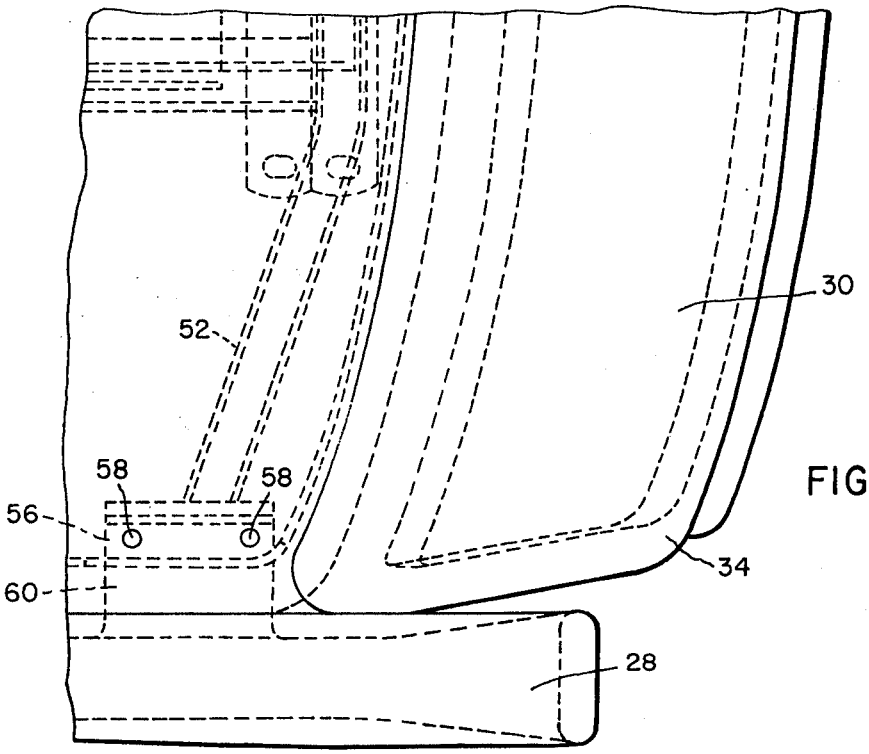
FIG. 3 is a top plan view of one quadrant of the chair of FIG. 1.
Figure 4:
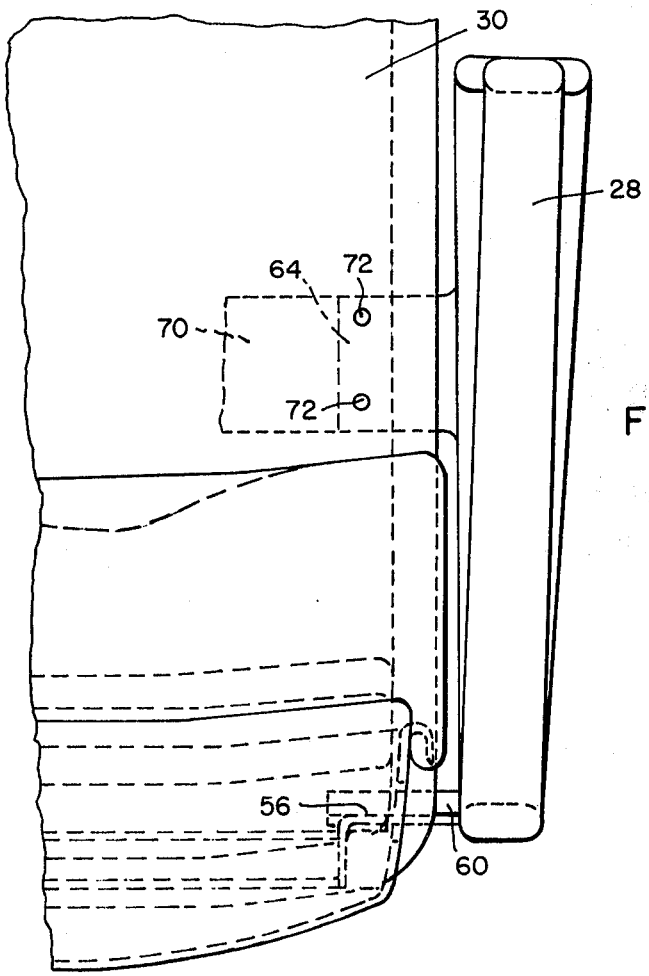
FIG. 4 is a front elevational view of one side of the chair of FIG. 1.

The third frame member 46 is pivotally mounted on the first frame member or support members 36 by means of a pivot pin 48. The third frame member is extended rearwardly from the pin 48 and has mounted thereon, in jaws 50, a tubular elongated back mounting bar 52. As best illustrated in FIG. 5 the back mounting bar is connected to the third frame member through the jaws 50 adjacent the midpoint of said bar and extends laterally of the tilt mechanism in both directions. If desired, a slight forward bend can be provided at 54 to move the interconnection of the back mounting bar and the chair arms forward of the most rearward portion of the tilt mechanism. At the lateral ends of the back mounting bar 52 are welded arm support flanges 56. As best seen in FIGS. 3 and 4 the flanges 56 are bolted at 58 to internally directed flanges or tabs 60 on the chair arms 28. These lower chair arm mounting flanges 60 extend through apertures 62 (FIG. 1) in the bottom molded shell 24 of the seat. Similar inwardly directed flanges or tabs 64 on the chair arms 28 extend through apertures 68 in the side walls of the molded chair back 32 and connect to a chair back support member 70 as at 72 by, for example, bolts. The chair back support member 70 extends from the tab 64 on one of the chair arms 28 across the back of the chair and connects at its other end to a tab 64 on the other chair arm 28 in a similar fashion. As will be apparent, the chair back 32, 34 is completely supported through the chair arms 28 on the laterally extending ends of the back mounting bar 52.

A back height adjustment mechanism can be included in the interconnection of the chair back support member 70 and the chair back structural member 30 in a manner disclosed in copending application Ser. No. 473,951 for "Chair Back Height Adjustment Mechanism" filed the same day as this application, by the same inventor, and owned by the same assignee.

The third frame member 46, a portion of which extends into the pan-shaped second frame member 40 is pivotally mounted thereto by an additional pivot pin 49 which interconnects the second and third frame members for pivotal movement therebetween. When a person leans back on the chair the force is transmitted through the chair arms 28 and the back mounting bar 52 to the third frame member 46 which rocks about the pivot pin 49. At the same time, because of the pivotal connection between the support members or first frame member 36 and the third frame member 46, established by the pivot pin 48 the seat and support members are rocked on the pins 42. The result is that the seat is given a slight slope to the rear, the amount of tilt will be dependent upon the extent of backward tilt of the chair back.

Tilt resisting spring biasing means is provided for the chair control to urge the chair back to a normal or first position. This spring means comprises a coiled torsion spring 74 including a pair of oppositely wound coils 76, 78 coiled about the hinge pin 49 and mounted between the spaced apart side walls of the third frame member 46. The torsion spring 74 also includes oppositely extending ends 75 to each of said coils which engage against the member 46, the opposite ends of each coil being joined together by a connecting portion 80. The connecting portion 80 of the coil springs 74 is connected to the second frame member 40 by connecting means comprising a threaded rod 82 which is hooked at one end over the connecting portion 80 and which extends at its other end through the bottom of the pan-shaped second frame member 40 and is threaded into a manually operable tension adjusting nut 83.

The ends 75 of spring 74 act on the member 46 to hold the seat and chair back in the normal position, in which position the forward ends 84 of the third frame member 46 are engaged against the inside of the bottom portion of the second frame member 40. This constitutes a stop means for holding the two members in their normal position. The rearwardly extending portion of the member 40 acts as a stop 86 which is engaged by the member 46 at the limit of the backward tilt of the chair back.

The foregoing is an illustration of the chair construction of the present invention employed in connection with one of the more complicated tilt mechanisms which conventionally provide for tilting of the seat with respect to the back but in a lesser degree as the back tilts. This type of chair is more generally known as an executive type chair. As this description proceeds with respect to the embodiment of FIG. 2, it will be seen that the broad concept of this invention can be employed in conjunction with less complex tilt mechanisms for use in connection with other smaller office chairs. Also disclosed with respect to the tilt mechanism of FIGS. 8, 9 and 10 is a chair back tilt adjustment which, as will be apparent, could be employed with equal success with the above described tilt mechanism for any executive type chair.

Figure 9:
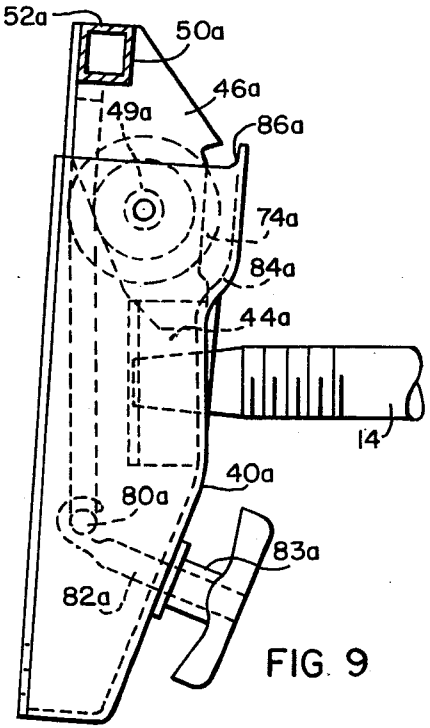
FIG. 9 is a side elevational view thereof.
Figure 8:
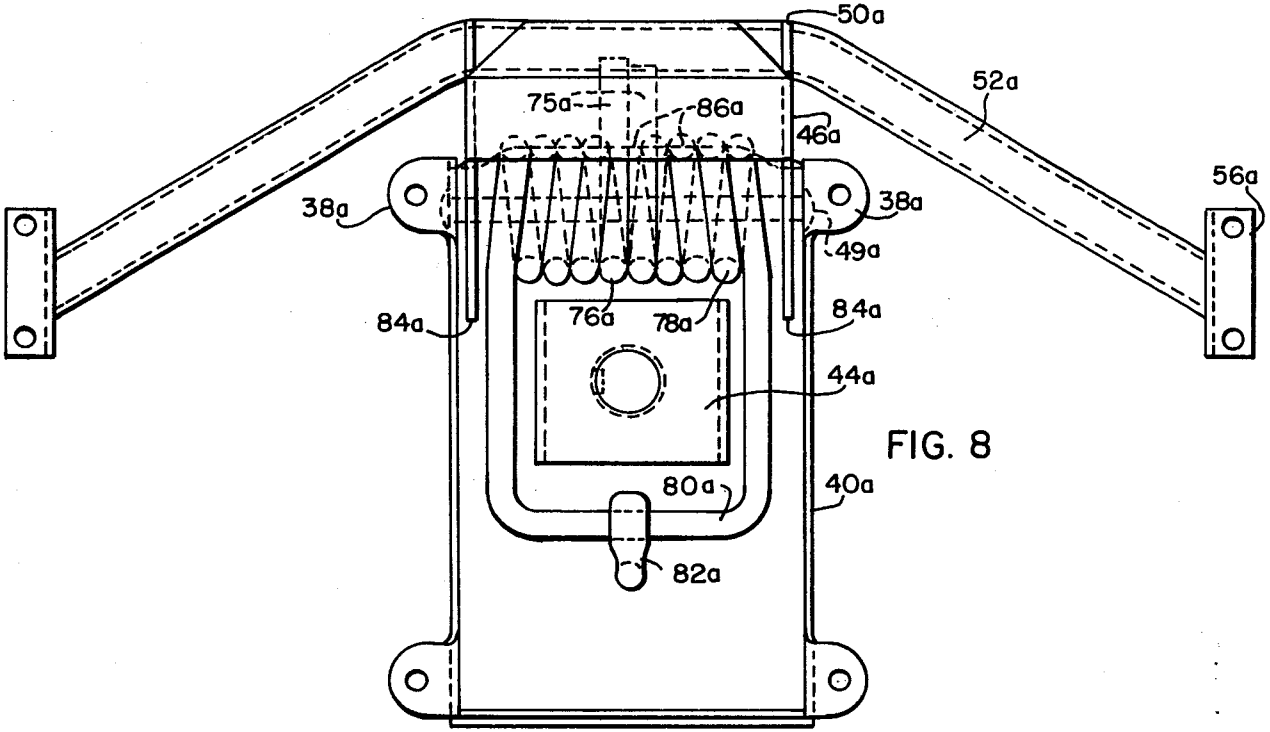
FIG. 8 is a top plan view of an alternative modified tilt mechanism constructed in accordance with this invention.
Figure 10:
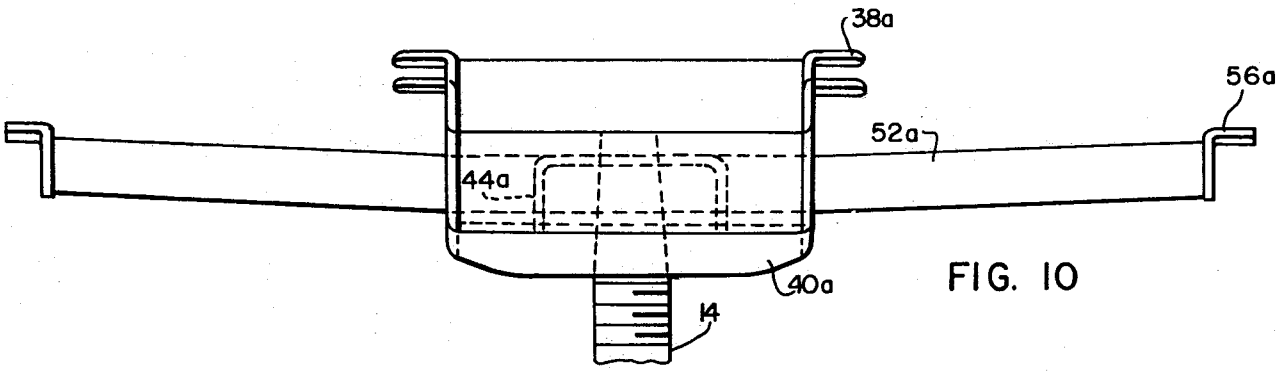
FIG. 10 is front elevational view of the modified tilt mechanism of FIG. 8.
Figure 13:
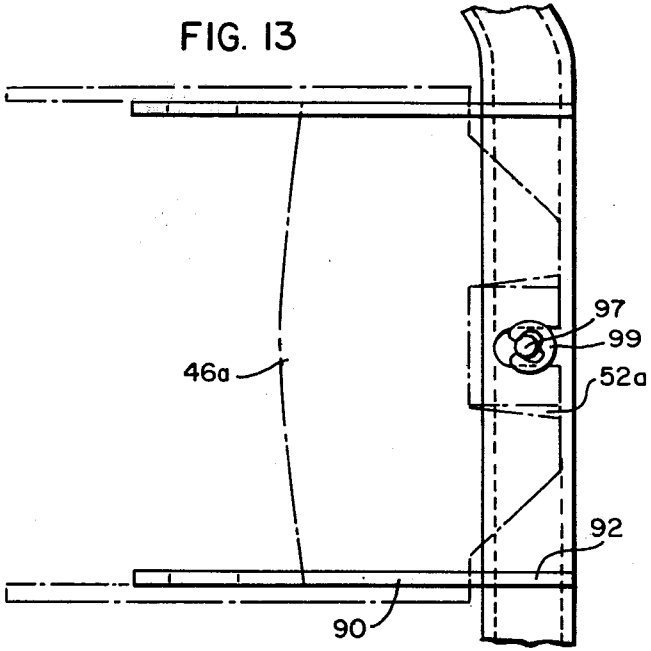
FIG. 13 is a top plan view of the support bar mounting arms.
Figure 14:
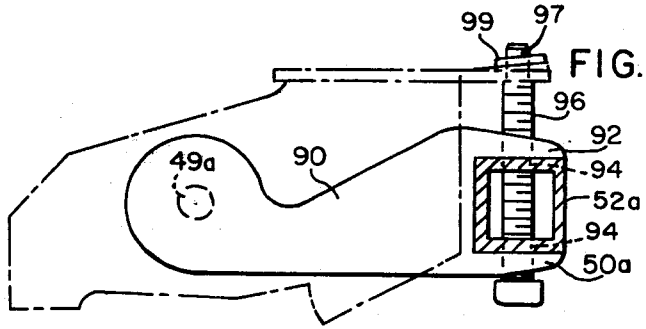
FIG. 14 is a side elevational view of the back tilt adjustment mechanism of the modified tilt mechanism control of FIG. 8.
Figure 11:
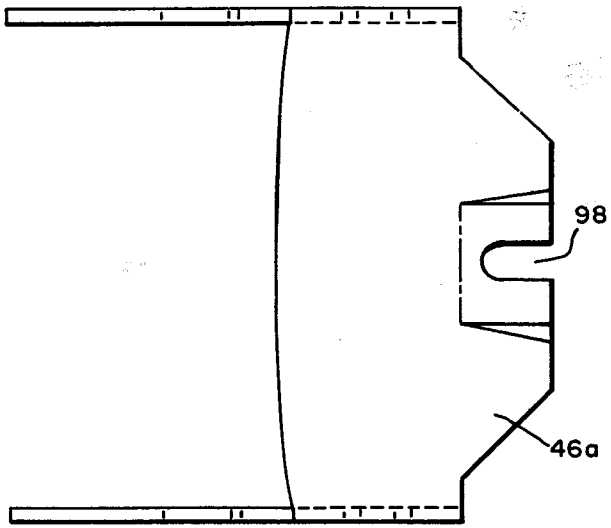
FIG. 11 is a top plan view of a portion of the back angle adjustment mechanism employed with the tilt mechanism of FIG. 8.
Figure 12:
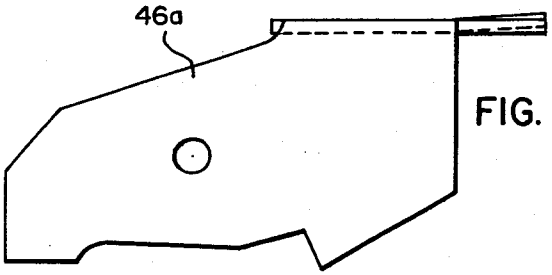
FIG. 12 is a side elevational view of the part of the angle adjustment mechanism illustrated in FIG. 11.
Figure 18:
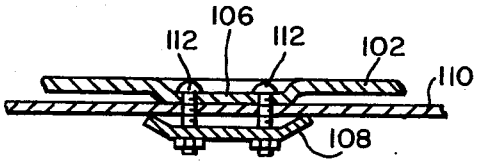
FIG. 18 is a sectional view taken along the line A—A of FIG. 17.
Figure 17:
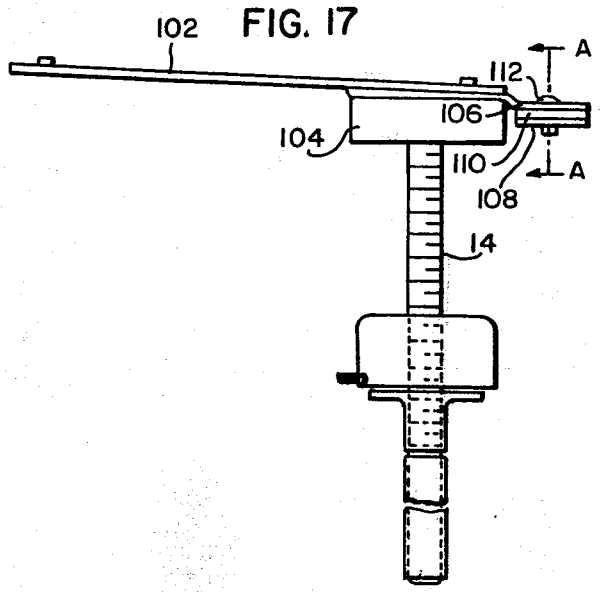
FIG. 17 is a side elevational view thereof.
Figure 15:
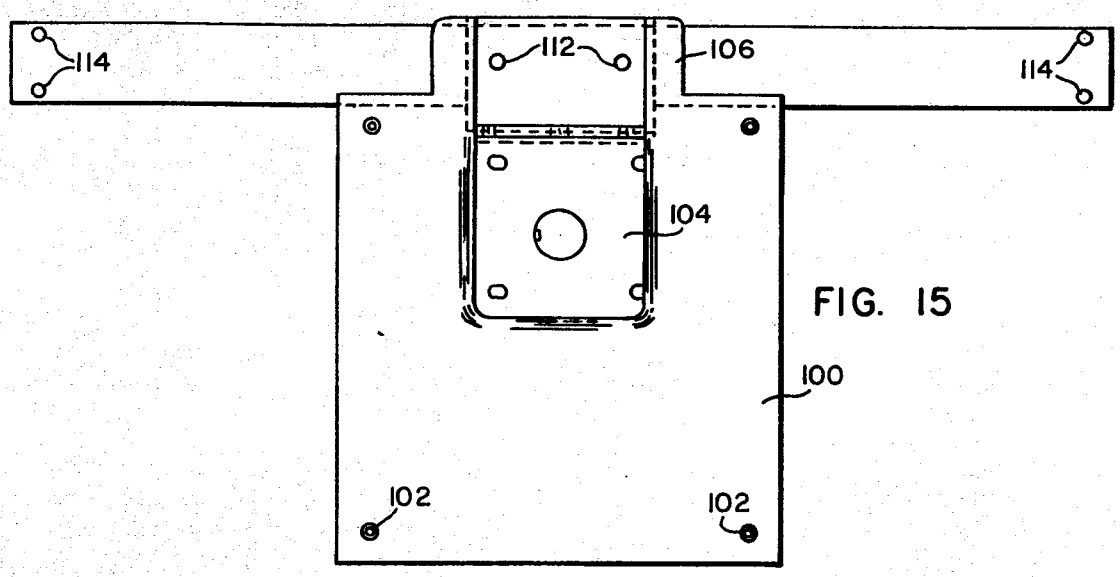
FIG. 15 is a top plan view of yet another modified tilt mechanism constructed in accordance with this invention.
Figure 16:
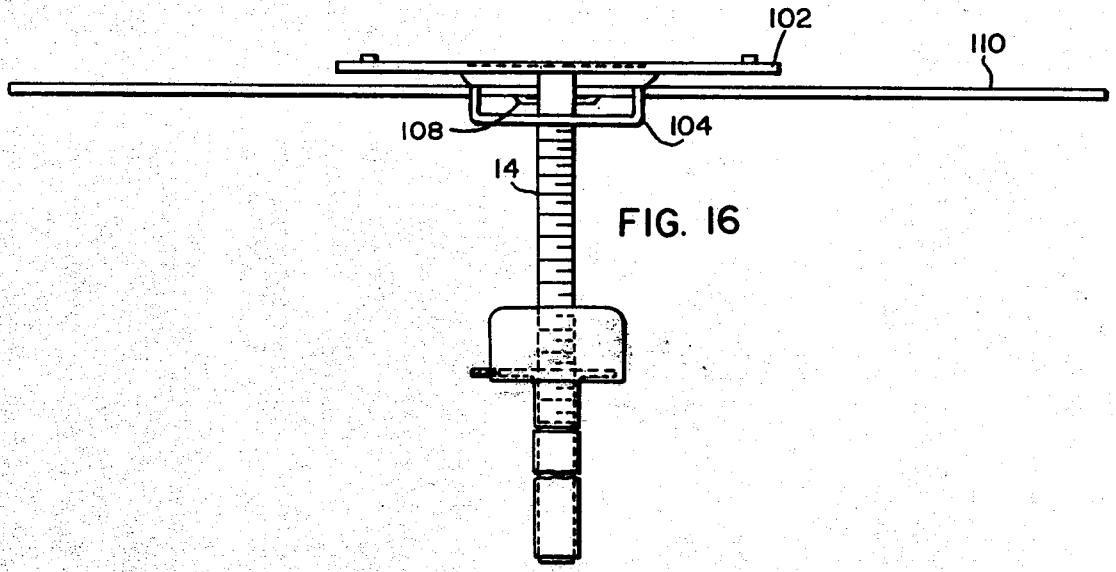
FIG. 16 is a front elevational view thereof.

The tilt mechanism employed in connection with FIGS. 8, 9 and 10 is quite similar to that disclosed with respect to the executive type chair except that the feature of the tilting seat is eliminated. Duplicate reference characters will be employed with an "*a*" designation for like parts between the respective embodiments. In this embodiment the pan-shaped frame member **40*a* is secured directly to the seat structural member as at 38*a* and the member 40*a* includes means for mounting to a conventional chair post or spindle 14 which comprises an inverted U-shaped plate 44*a* having a corresponding aperture to the aperture in the pan-shaped member 40*a* to receive the top ends of the chair base spindle 14 in a conventional manner. In this embodiment the frame member 46*a* is mounted to pan-shaped frame member 40*a* by means of pivot pin 49*a* and at its rearward end a pair of jaws 50*a* have welded therein tubular back mounting bar 52*a* as illustrated best in FIG. 9. Again tilt resisting spring biasing means is provided for the chair control to urge the chair back to a normal or first position. This spring means comprises a coiled torsion spring 74*a* including a pair of oppositely wound coils 76*a*, 78*a* coiled about the hinge pin 49*a* and mounted between the spaced apart side walls of the frame member 46*a*. The torsion spring 74*a* also includes oppositely extending ends 75*a* to each of said coils which engage against the member 46*a*, the opposite ends of each coil being joined together by a connecting portion 80*a*. The connecting portion 80*a* of the coil springs 74 *a* is connected to the pan-shaped frame member 40*a* by connecting means comprising a threaded rod 82*a* which is hooked at one end over the connecting portion 80*a* and which extends at its other end through the bottom of the pan-shaped frame member 40*a* and is threaded into a manually operable tension adjusting nut 83*a***.

The ends **75*a* of spring 74*a* act on the member 46*a* to hold the chair in the normal position, in which position the forward ends 84*a* of the frame member 46*a* are engaged against the inside of the bottom portion of the frame member 40*a*. This constitutes a stop means for holding the two members in their normal position. The rearwardly extending portion of the member 40*a* acts as a stop 86*a* which is engaged by the member 46*a*** at the limit of the backward tilt of the chair back.

The tubular back mounting bar **52*a* again extends laterally in both directions from the gripping jaws 50*a* into which it is welded and terminates at its lateral extremities in mounting flanges 56*a***.

Figure 2:
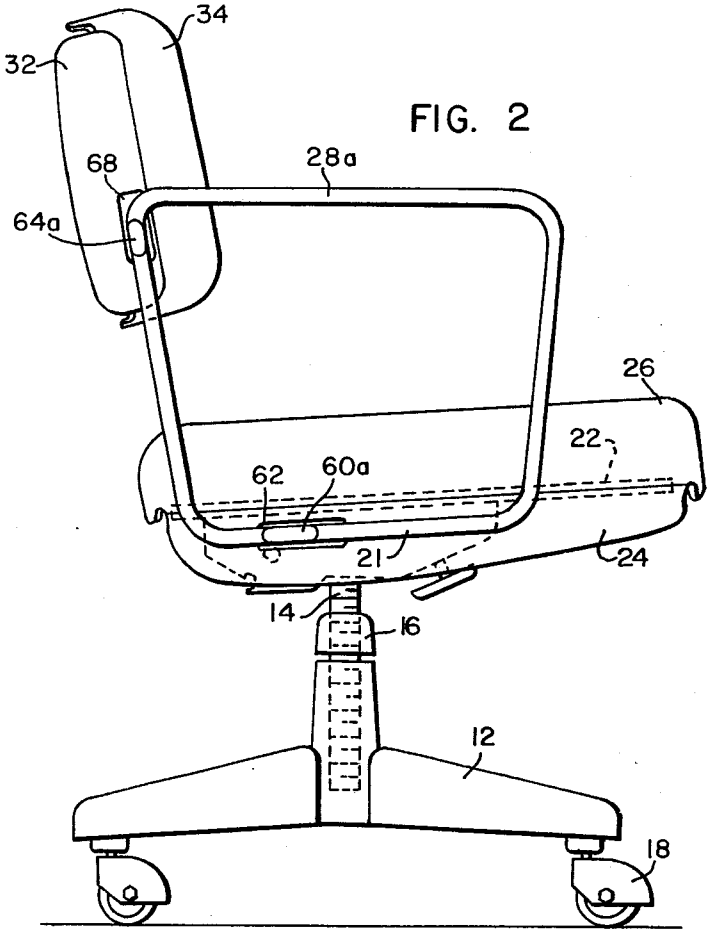
FIG. 2 is a side elevational view of a smaller arm chair constructed in accordance with this invention.

As may be seen from FIG. 2, a chair employing the tilt mechanism arrangement of FIGS. 8, 9 and 10 will also carry chair arms **28*a* through the interconnection of internally directed tabs 60*a* to flanges 56*a* and a back preferably of shorter dimensions will be mounted through tabs 64*a* on arms 28*a* to a back support member 70 in the same manner as illustrated in FIG. 4**.

The tilt mechanism of FIGS. 8, 9 and 10 may be modified, if desired, to provide for a simple back angle adjustment as employed with secretarial type chairs. In this regard the frame member **46*a* is modified as illustrated in FIGS. 11–14. The back mounting bar 52*a* is welded to a pair of mounting arms 90 in jaws 92 thereof. The mounting arms 90 are in turn mounted on the inside of the sidewalls of frame member 46*a* by the same pivot pin 49*a* employed to mount the frame member 46*a* to the pan-shaped frame member 40*a*. A threaded aperture 94 is provided in the back mounting bar 52*a* at approximately its mid-point and a threaded bolt 96 extends vertically therethrough and terminates in a reduced end portion 97 which is located in a slot 98 provided in the rearward end of frame member 46*a*. A chip 99 retains the upper end of threaded bolt 96 in the slot 98. As will be apparent, rotation of the threaded bolt 96 will adjust the distance between the back mounting bar 52*a* and the slot 98 in frame member 46*a*** and hence the angular relationship of the chair back to the chair seat when the chair back is in its normal non-tilted position.

Referring now to an even more simplified tilt mechanism involving the basic inventive concept of a chair back being mounted to the tilt mechanism through the chair arms there is illustrated in FIGS. 15, 16, 17 and 18 a modified and simplified tilt mechanism which employs a flat structural plate 100 which may be directly connected to the chair seat structural member 22 as at the four corners 102. Welded or otherwise secured to the bottom of the plate 100 is a apertured mounting box 104 through which the conventional chair post or spindle 14 is connected. A rearwardly directed depressed extension 106 extends from the plate 100 and is integral therewith. A slightly curved clamping plate 108 is employed to clamp an elongated steel mounting bar 110 to the underside of extension 106 through means of a pair of bolts 112. At the ends of the bar 110 are mounting holes 114 which may be connected to the internally directed tabs 60 on chair arms 28 in the same manner as that disclosed with respect to the two previous tilt mechanisms. The basic inventive concept of the back of the chair being mounted through the arms to a centrally located tilt mechanism below the seat by means of a laterally extending back mounting bar connected proximate its midpoint to the tilt mechanism finds essential continuity in this embodiment. The principal difference in this construction is that tilt restraint and control is provided by the inherant torsional spring-like characteristics of the elongated steel mounting bar 110. A more or less resilient seat back is provided by this configuration as the elongated flat back mounting bar 110 is proportionally flexed through the application of force or body weight to the chair back which in turn is transmitted through the chair arms to the back mounting bar 110.

As will be seen from the foregoing, in each of the disclosed tilt mechanism embodiments, a comfortable office chair is provided in which, in each instance, the arms of the chair tilt in conjunction with the tilt of the back and the back of the chair is supported solely through the arms of the chair. No central vertical connection directly from the tilt mechanism to the back of the chair is provided which can be both subject to structural failure and provide a unsightly appearance. More specifically, there is no relative movement between the chair arms and the chair back when the user tilts backward in the chair and no gap can be opened between the chair back and the ends of the arms when the chair back is tilted to its maximum extent. Additionally, since the chair arms are interconnected to the tilt mechanism at their bottom and to the seat back support member which extends across the back of the chair between the two arms at the top of the chair, the chair arms are far more sturdy with respect to the application of lateral force on their upper ends.

What is claimed is:

1. An improved chair construction for office type chairs and the like, comprising:

a base for supporting the chair on a floor;

a spindle extending substantially vertically from said base;

a tilt mechanism connected to the upper end of said spindle, said tilt mechanism including first, second and third interconnected frame members, with said second frame member connected to said spindle;

a chair seat structural member, having a molded shell on one side thereof and said molded shell having apertures on the side edges thereof, said first frame member connected to said chair seat structural member;

a back mounting bar connected to said third frame member proximate the midpoint of said bar and extending laterally of said tilt mechanism in both directions;

a pair of chair arms, one of said chair arms being fixed, within said molded shell through said apertures, to each laterally extending end of said back mounting bar;

a chair back structural member;

a chair back support member constructed and arranged to carry and support said chair back structural member, said chair back support member extending across the back of said chair and being secured at each extremity to one of said chair arms, whereby force applied to the back of said chair will cause said chair back to tilt with respect to said seat and said arms will move with said back.

2. The improved chair construction of claim 1 wherein said chair seat structural member and said chair back structural member are both enclosed on one side by a fabric covered cushion and on the other side by a molded shell, said molded shells both having apertures on their side edges through which said chair arms are connected to said lateral extending ends of said back mounting bar and said back support member respectively.

3. The improved chair construction of claim 2 wherein each of said chair arms include internally directed tabs which extend into said apertures in said molded shells to facilitate connection of said laterally disposed chair arms to said back mounting bar and said chair back support member interiorly of said molded shells.

4. The improved chair construction of claim 1 wherein means is associated with said third frame member and said back mounting bar to vary the angular relationship therebetween and hence the angular relationship between said seat structure and said chair arms and back structure.

* * * * *